United States Patent [19]

Reeves et al.

[11] 4,010,414

[45] Mar. 1, 1977

[54] ADVANCE AND RETARD TIMING LIGHT

[75] Inventors: George I. Reeves; Jack J. Keegan, both of Fullerton, Calif.

[73] Assignee: Beckman Instruments, Inc., Fullerton, Calif.

[22] Filed: Nov. 26, 1975

[21] Appl. No.: 635,740

[52] U.S. Cl. ..... 324/16 T

[51] Int. Cl.[2] ..... F02P 17/00

[58] Field of Search ..... 324/16 T, 15

[56] References Cited

UNITED STATES PATENTS

| | | | |
|---|---|---|---|
| 3,499,322 | 3/1970 | Pelta et al. | 324/16 T |
| 3,597,677 | 8/1971 | MacCrea et al. | 324/16 T |
| 3,638,107 | 1/1972 | Pelta et al. | 324/16 T |
| 3,650,149 | 3/1972 | Howes | 324/16 T X |
| 3,813,931 | 6/1974 | Rennick et al. | 324/16 T X |
| 3,863,498 | 2/1975 | Gunther | 324/16 T X |

*Primary Examiner*—Stanley T. Krawczewicz
*Attorney, Agent, or Firm*—R. J. Steinmeyer; P. R. Harder; D. A. Streck

[57] ABSTRACT

A timing control circuit for a strobe lamp for use in adjusting the timing of an internal combustion engine. A circuit which provides for retarding lamp triggering for setting ignition advance and for advancing lamp triggering for setting ignition retard. A circuit providing for advance and retard selection, the amount of advance or retard, and zero degree triggering for engines with various numbers of cylinders. A circuit with a ramp voltage synchronized with engine timing, a reference voltage for setting the amount of advance or retard, and a comparator which provides a triggering signal for the lamp when the ramp and reference voltages match.

15 Claims, 1 Drawing Figure

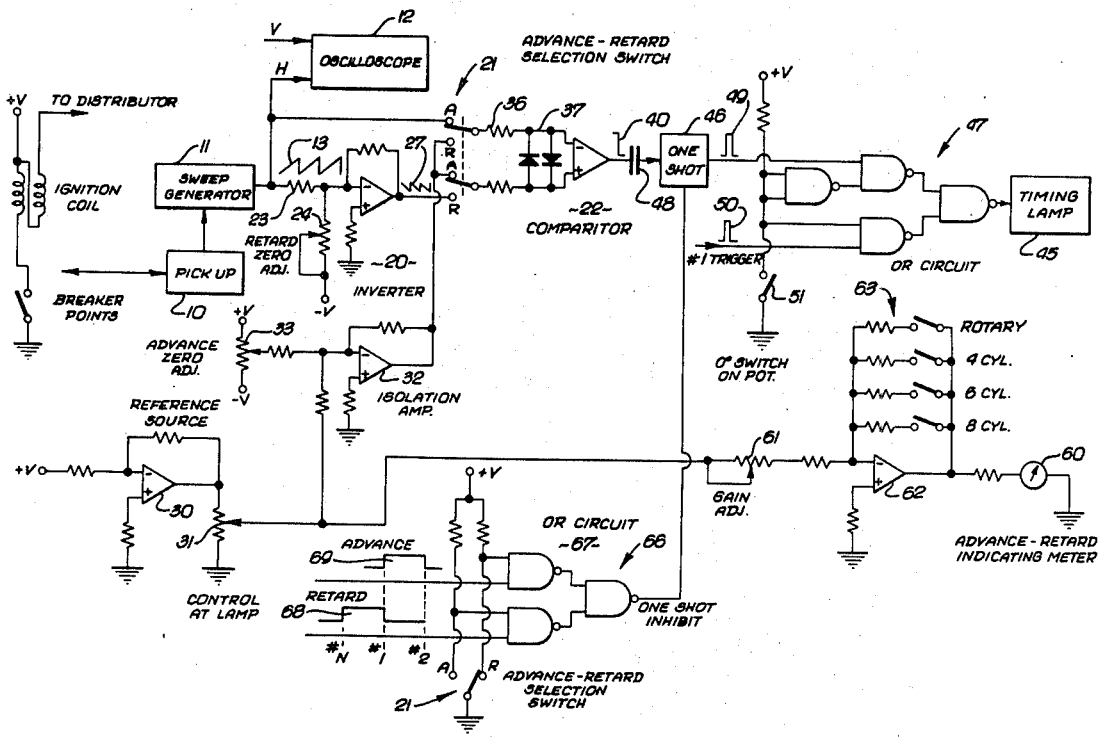

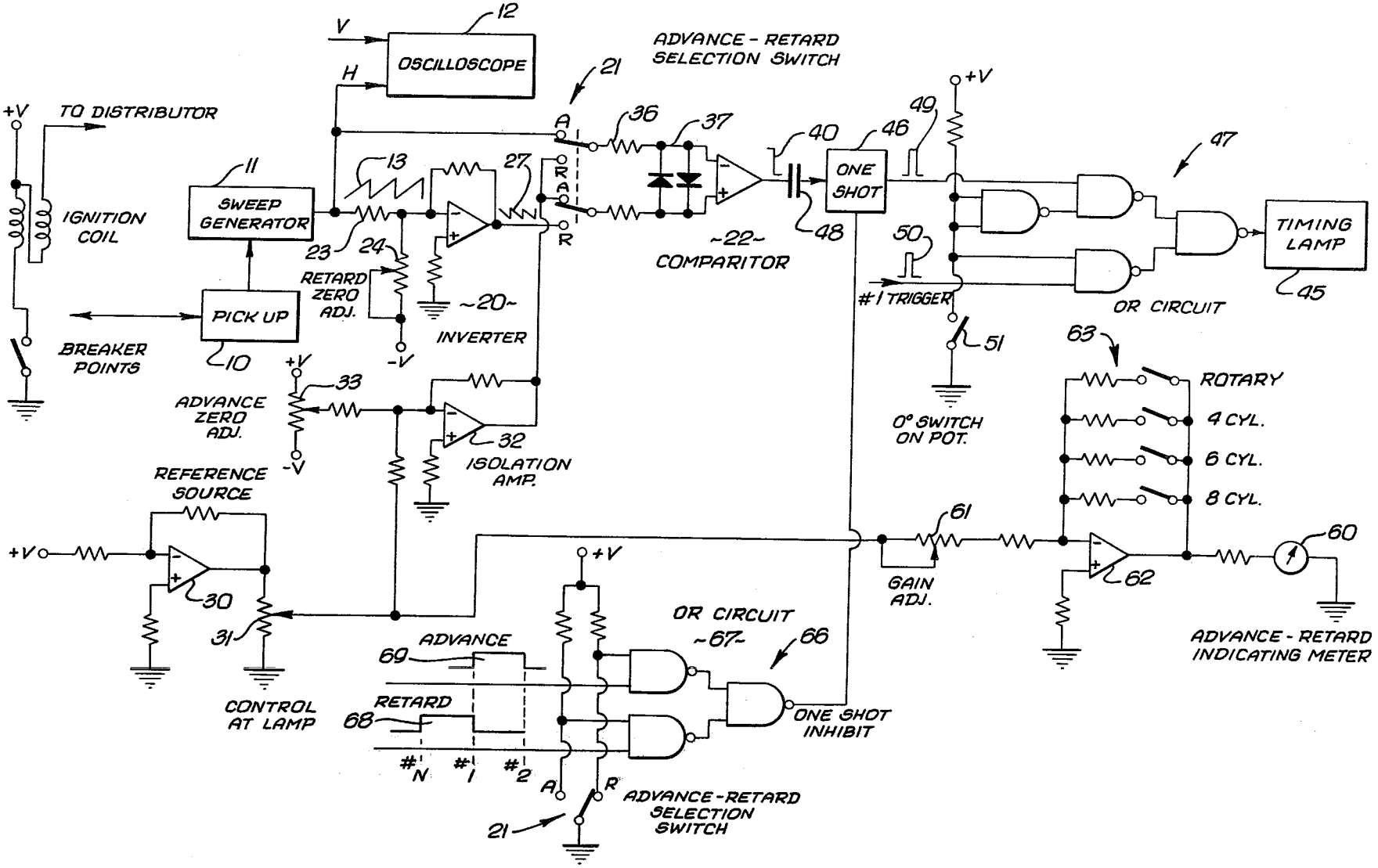
TIMING LAMP
45
47
OR CIRCUIT
ROTARY
4 CYL.
6 CYL.
8 CYL.
60
ADVANCE - RETARD INDICATING METER
62
63
+V
51
0° SWITCH ON POT.
61
GAIN ADJ.
49
50
#1 TRIGGER
46
ONE SHOT
48
40
ADVANCE - RETARD SELECTION SWITCH
37
~22~ COMPARITOR
36
21
A
R
ONE SHOT INHIBIT
66
OR CIRCUIT ~67~
ADVANCE-RETARD SELECTION SWITCH
12
OSCILLOSCOPE
27
~20~ INVERTER
32
ISOLATION AMP.
ADVANCE
RETARD
#2
#1
#N
69
68
V
H
13
24
23
RETARD ZERO ADJ.
-V
33
11
SWEEP GENERATOR
PICK UP
10
ADVANCE ZERO ADJ.
REFERENCE SOURCE
30
31
CONTROL AT LAMP
TO DISTRIBUTOR
IGNITION COIL
BREAKER POINTS

ADVANCE AND RETARD TIMING LIGHT

BACKGROUND OF THE INVENTION

This invention relates to engine ignition analyzers, i.e., engine tune-up equipment, and in particular to a new and improved strobe or timing lamp.

A standard accessory for use with the conventional engine analyzer is the strobe or timing lamp which provides a pulse of light of very short duration. In a typical internal combustion engine, a fixed reference mark is provided on the engine housing adjacent the flywheel which carries another reference mark. When these two reference marks are aligned, the engine is in the top dead center position which normally corresponds to the firing time for the number 1 cylinder.

The conventional strobe lamp is triggered by the number 1 cylinder firing signal during running of the engine producing the repeating short light pulse permitting visual determination by the mechanic of the actual engine flywheel position with respect to the fixed reference mark for any engine speed. Originally, the mechanic noted the difference between the two reference marks, typically in degrees scribed on the flywheel, to determine the amount of advance of number 1 cylinder firing signal with respect to top dead center. In improved timing lamps, a variable delay was introduced into the timing lamp so that the lamp trigger pulse was delayed with respect to the number 1 cylinder firing signal. In using this improved lamp, the mechanic adjusted the delay so that the two reference marks were aligned when the lamp was triggered and read the calibration of the delay adjustment in terms of degrees of advance.

This type of device generated a voltage proportional to engine speed which voltage was used as a reference for the delay circuit. This simple delay circuit has been satisfactory for prior engines which were set at some amount of advance.

The present day engines, particularly those equipped with pollution control devices, incorporate both advance and retard mechanisms, and some engines are set at a retarded position at idling speed. The simple time delay circuits utilized with the prior art strobe lamps cannot be used for measuring retard settings, that is, the lamps cannot be utilized to advance the lamp firing ahead of the cylinder firing signal. Accordingly, it is an object of the present invention to provide a new and improved method and apparatus for controlling the firing of a strobe lamp.

It is a particular object of the invention to provide a new and improved control method and apparatus for an engine strobe lamp suitable for measuring both advance and retard engine timing. A further object is to provide such a device which is suitable for use with engines of various numbers of cylinders, and one which can be utilized to provide lamp firing at the zero degree position as well as advance and retard positions.

SUMMARY OF THE INVENTION

The invention includes a method of retarding and advancing the triggering of a strobe lamp with respect to the top dead center timing of an engine for providing advance and retard engine settings and including detecting the occurrence of engine ignition timing events, generating a ramp voltage and an inverted ramp voltage synchronized with the engine timing, generating a reference voltage which varies as a function of the desired deviation of lamp triggering from top dead center, selecting one of the ramp and inverted ramp voltages depending on whether the lamp triggering is to be retarded or advanced, and triggering the strobe lamp when the selected voltage and the reference voltage are matched.

The invention also includes a timing control circuit for such a strobe lamp including circuitry for producing a ramp voltage synchronized with the engine ignition timing, circuitry for producing the reference voltage including means for varying the reference voltage as a function of the desired amount of deviation, a comparator having the ramp and reference voltages as inputs and providing an output for use as a trigger voltage when the ramp voltage matches the reference voltage. The circuit further includes an inverter for producing an inverted ramp voltage, and an advance-retard selection switch for selecting one of the ramp and inverted ramp voltages as an input to the comparator.

BRIEF DESCRIPTION OF THE DRAWING

The single FIGURE of the drawing is an electrical diagram of a strobe or timing lamp control incorporating the presently preferred embodiment of the invention.

DESCRIPTION OF THE PREFERRED EMBODIMENT

The instrument illustrated in the drawing includes a pickup 10, a sweep generator 11, and an oscilloscope 12, all of which may be conventional components of the prior art engine analyzers. The pickup 10 may be directly or inductively or capacitively coupled to the engine ignition circuit and provides electrical signals as an output which correspond to engine timing events. The sweep generator 11 provides a ramp voltage 13 for the horizontal trace of the oscilloscope. Various sweep generators may be utilized for producing the ramp voltage, and a preferred form is disclosed in the copending application of Reeves et al entitled SWEEP GENERATOR FOR ENGINE ANALYZER, Ser. No. 635,741, filed Nov. 26, 1975, and assigned to the same assignee as the present application. The sweep generator may provide a ramp for each cylinder firing signal or a ramp for the entire group of cylinders of the engine, the latter being known as the parade mode. The former is preferred because it normally gives a more stable performance for the control circuit.

The circuit includes an inverter 20, a selection switch 21, and a comparator 22. The ramp voltage 13 is connected to one fixed terminal (A) of one contact set of the advance-retard selection switch 21, and as an input to the inverter 20 through a resistor 23, with the inverter input connected to a negative voltage source through a variable resistor 24 which provides a zero adjustment. The inverter output is an inverted ramp voltage 27 which is connected to a fixed terminal (R) of another contact set of the switch 21.

A reference voltage is connected to a fixed terminal (R) of the first contact set of the switch 21 and to a fixed terminal (A) of the second contact set. In the embodiment illustrated, the reference voltage is provided by an amplifier 30, a control potentiometer 31 and another amplifier 32 to form a positive voltage source. The potentiometer 31 provides for variation of the reference voltage by the mechanic or other person utilizing the strobe lamp. The amplifier 30 provides isolation of the control potentiometer from the voltage source and the amplifier 32 provides inversion of the reference voltage and isolation. A potentiometer 33 is connected across positive and negative voltage sources, with the moving arm connected to the input of amplifier 32 to provide a bias for the advance zero adjustment.

The moving terminals of the first and second contact sets of the switch 21 are connected to the inputs of the comparator 22 through resistors 36 and diodes 37 which protect the input from large differential voltages. In the embodiment illustrated, the output of the comparitor is a negative going step 40 generated when the negative input matches the positive input. When the switch 21 is in the position illustrated, connecting the A terminals as inputs, the circuit is in the advance mode and the comparator output is generated when the rising voltage of the ramp 13 matches the level of the reference voltage. With the switch in the opposite or retard position connecting the R terminals as comparator inputs, the comparitor output step 40 is generated when the falling voltage of the ramp 27 reaches the level of the reference voltage.

The comparator output 40 provides the triggering signal for the lamp 45, preferably through a one shot multivibrator 46 and an OR circuit 47. The negative going step 40 is connected to the one shot 46 through a capacitor 48, with the one shot providing a voltage pulse 49 as an output. The OR circuit 47 connects either the voltage pulse 49 or a voltage pulse 50 as the trigger pulse to the lamp 45, depending on the setting of switch 51. With the switch 51 in the open position as shown in the drawing, the pulse 50 provides the triggering. With the switch 51 closed, the pulse 49 provides the triggering. Typically the pulse 50 is generated in the engine analyzer and corresponds in time to the firing signal for the number 1 cylinder, that is, top dead center for the engine which is zero degrees advance and retard. The switch 51 preferably is mounted with the potentiometer 31 so that when the operator sets the desired deviation (advance or retard) at or close to 0°, the switch 51 is closed. This provides direct control of the timing lamp from the engine timing signals without advance or retard from the timing control circuit.

The reference voltage is also connected as an input to a meter 60 through a gain adjustment resistor 61 and amplifier 62. The meter may be calibrated to read directly in degrees of advance or retard. A plurality of gain control circuits 63 are connected across the amplifier 62, each comprising a resistor and switch in series. The appropriate switch is closed, depending on whether the engine under test is a four, six or eight cylinder reciprocating engine or a rotary engine, to provide the appropriate gain for the meter 60.

Ordinarily the timing lamp 45 would be fired for each ramp of the sweep generator output. When there is a ramp for each cylinder firing, this would produce excessive lamp firing, since in ordinary engines, the moving reference mark appears adjacent the fixed reference mark only at the time of firing of number 1 cylinder. An inhibit circuit 66 is provided for inhibiting lamp firing except at the time of number 1 cylinder firing. The inhibit circuit includes an OR circuit 67 having as one input a pulse 69 which is true from the firing time of number 1 cylinder to the firing time of number 2 cylinder, and another pulse 68 which is true from the firing time of the cylinder preceding number 1 cylinder to the firing time of number 1 (N). While cylinders are referred to herein, the system is equally useable with rotary engines, where the number of rotors usually corresponds to the number of cylinders in a reciprocating engine. Another contact set of the advance-retard selection switch 21 provides inputs to the OR circuit 67 so that the one shot multi-vibrator 46 is inhibited except during the number 1 pulse 69 when engine advance setting is desired, or during number N pulse 68 when engine retard setting is desired.

In operation, the potentiometer 31 may initially be set at the zero degrees position with the switch 51 closed and with the switch 21 in the advance position. Then the timing lamp is fired by the number 1 cylinder pulse and the engine condition may be determined by visually observing the distance between the reference marks. When the reference marks are aligned, the timing deviation is 0°.

If the potentiometer 31 is moved to a new setting, say three degrees, and one of the switches 63 is closed, say the eight cylinder switch, the meter 60 will indicate three degrees. The comparator will provide the negative step output 40 when the magnitude of the ramp 13 rises to the magnitude of the reference voltage, which delays the firing of the lamp 45 a period of time corresponding to three degrees of flywheel rotation. If the selection switch 21 is moved to the retard position, the comparator output will be provided when the inverted ramp for cylinder N falls to the magnitude of the reference voltage with the result that the timing lamp is fired prior to the firing of the number 1 cylinder by the desired three degrees.

While specific polarities have been used in the preceding description, it will be readily understood that the invention is not so limited and that different polarities may be used as desired.

We claim:

1. A timing control circuit for a strobe lamp for use in the adjustment of an internal combustion engine having a fixed reference mark and a moving reference mark with an engine adjustment reference point occurring when said reference marks are aligned, comprising:

means for producing an increasing ramp voltage synchronized with the engine ignition timing;

means for producing a decreasing ramp voltage synchronized with the engine ignition timing;

means for producing a reference voltage including means for varying said reference voltage as a function of the desired amount of deviation of lamp flash from the occurrence of the engine adjustment reference point;

a comparator having first and second input terminals and providing an output pulse when a positive going voltage applied to said first terminal equals a reference voltage applied to said second terminal and when a negative going voltage applied to said second terminal equals a reference voltage applied to said first terminal;

first switch means for connecting said increasing ramp voltage and said reference voltage to said first and second terminals respectively of said comparator when in a first position and connecting said decreasing ramp voltage and said reference voltage to said second and first terminals respectively when in a second position whereby advance or retard deviation of lamp flash can be selected; and means for connecting said comparator output to the strobe lamp as a trigger voltage.

2. A timing control circuit as defined in claim 1 including:

a deviation indicating meter; and means for connecting said reference voltage to said meter for indicating the set amount of deviation.

3. A timing control circuit as defined in claim 2 wherein said connecting means includes an amplifier, a plurality of amplifier gain control circuits corresponding to the number of cylinders of engines, and second switch means for selecting one of said gain control circuits for said amplifier.

4. A timing control circuit as defined in claim 1 including:

an inverter having said increasing ramp voltage as an input and providing said decreasing ramp voltage as an output.

5. A timing control circuit as defined in claim 3 wherein said connecting means includes an OR circuit having the comparator output and an engine timing signal corresponding to the adjustment reference point as inputs, and third switch means for controlling said OR circuit to select as the output thereof either said comparator output or said engine timing signal.

6. A timing control circuit as defined in claim 5 wherein said means for varying said reference voltage includes a manually actuated potentiometer, with said third switch means actuated by said potentiometer when at the zero deviation position.

7. A timing control circuit as defined in claim 1 wherein said connecting means includes an OR circuit having the comparator output and an engine timing signal corresponding to the adjustment reference point as inputs, and third switch means for controlling said OR circuit to select as the output thereof either said comparator output or said engine timing signal.

8. A timing control circuit as defined in claim 7 wherein said means for varying said reference voltage includes a manually actuated potentiometer, with said third switch means actuated by said potentiometer when at the zero deviation position.

9. A timing control circuit as defined in claim 8 wherein said connecting means includes a one shot multi-vibrator triggered by said comparitor output and providing a trigger pulse for said strobe lamp.

10. A timing control circuit as defined in claim 1 wherein said increasing and decreasing ramp voltages repeat for every engine cylinder firing time, and including an inhibit circuit for preventing lamp triggering except in conjunction with a selected cylinder firing time, said inhibit circuit including an OR circuit having as inputs engine timing signals corresponding to the number 1 cylinder firing time and to the number N cylinder firing time, where N is the number of the cylinder firing just before cylinder number 1, and fourth switch means for selecting the number 1 cylinder timing signal when an advance engine setting is desired and selecting the N cylinder timing signal when a retard engine setting is desired.

11. A timing control circuit as defined in claim 10 wherein said connecting means includes a one shot multi-vibrator triggered by said comparitor output and providing a trigger pulse for said strobe lamp, with said inhibit circuit connected to said multi-vibrator.

12. A method of retarding and advancing the triggering of a strobe lamp with respect to an adjustment reference point of an engine, including the steps of:

detecting the occurrence of engine ignition timing events;

generating an increasing ramp voltage and a decreasing ramp voltage synchronized with the engine ignition timing;

generating a reference voltage of a magnitude varying as a function of the desired strobe lamp triggering deviation from the adjustment reference point;

selecting one of the increasing ramp and decreasing ramp voltages depending on whether the strobe lamp triggering is to be retarded or advanced; and triggering the strobe lamp when the selected voltage and the reference voltage are matched.

13. The method of claim 12 including triggering the strobe lamp in synchronism with the engine number 1 cylinder firing signal when the desired amount of deviation is zero.

14. The method of claim 12 including:

generating a ramp voltage for each cylinder of the engine; and inhibiting strobe lamp triggering except in conjunction with a selected one of the engine cylinder firing signals.

15. The method of claim 14 including inhibiting strobe lamp triggering except for the number 1 cylinder firing signal when retarded triggering is desired and inhibiting strobe lamp triggering except for the number N cylinder firing signal when advanced triggering is desired, where N is the number of the cylinder firing just before cylinder number 1.

* * * * *